US011612202B2

(12) United States Patent
Bancic

(10) Patent No.: US 11,612,202 B2
(45) Date of Patent: Mar. 28, 2023

(54) DEVICE AND METHOD FOR INTEGRATING HAIR EXTENSIONS

(71) Applicant: Invisastrands LLC, Hicksville, NY (US)

(72) Inventor: Marie Bancic, Bellmore, NY (US)

(73) Assignee: Invisastrands LLC, Hicksville, NY (US)

( * ) Notice: Subject to any disclaimer, the term of this patent is extended or adjusted under 35 U.S.C. 154(b) by 0 days.

(21) Appl. No.: 17/734,696

(22) Filed: May 2, 2022

(65) Prior Publication Data

US 2022/0264979 A1 Aug. 25, 2022

Related U.S. Application Data

(62) Division of application No. 17/089,664, filed on Nov. 4, 2020, now Pat. No. 11,317,668.

(51) Int. Cl.
*A41G 5/00* (2006.01)

(52) U.S. Cl.
CPC ..... *A41G 5/0073* (2013.01)

(58) Field of Classification Search
CPC ..... A41G 5/00; A41G 5/002; A41G 5/004; A41G 5/006; A41G 5/0013; A41G 5/0026; A41G 5/0033; A41G 5/0053; A41G 5/0073; A41G 5/008; A41G 5/0066; A41G 3/00; A41G 3/0008; A41G 3/0025; A41G 3/0033; A41G 3/0041; A41G 5/0046; A41G 5/0086
See application file for complete search history.

(56) References Cited

U.S. PATENT DOCUMENTS

2008/0295856 A1* 12/2008 Kallabat ..... A41G 5/0066 132/201
2014/0060566 A1* 3/2014 Walker ..... A41G 5/0073 132/201
2014/0338689 A1* 11/2014 Shuttleworth ..... A41G 5/0066 132/201
2015/0083154 A1* 3/2015 Lindsay ..... A41G 5/0066 132/201
2019/0208849 A1* 7/2019 Maman ..... A45D 8/36
2020/0245706 A1* 8/2020 Durand ..... A41G 5/0046

* cited by examiner

*Primary Examiner* — Amy R Sipp
*Assistant Examiner* — Karim Asqiriba
(74) *Attorney, Agent, or Firm* — Margaret Millikin

(57) ABSTRACT

A hair extension comprising plurality of bands having hair wefts secured thereto with micro loops adhered between the plurality of bands for attachment to the wearer's native hair. A first band has a front side and a back side and an extension weft is attached to either the front side or the backside, or both. micro links are attached with adhesive. A second band has a front side and a back side and may also have an extension weft attached to either the front side or the back side or both. Micro links are secure to either the back side of the first band or the back side of the second band, or both. The back sides of the two bands are sandwiched together with the micro links therebetween and with the extension hair exposed either exteriorly or interiorly. Also provided is a micro link wrapped with a material on which extension hair is secured. The wearer's native hair is pulled through an inner annulus of the micro link, thus concealing the micro link from view.

20 Claims, 14 Drawing Sheets

DEVICE AND METHOD FOR INTEGRATING HAIR EXTENSIONS

TECHNICAL FIELD OF THE INVENTION

The present invention relates generally to hair extensions and devices for integrating hair extensions into human hair. More particularly, but not by way of limitation, the present invention relates to hair to extensions comprising micro links and/or hair extensions comprising bands or strips. Methods of integrating hair extensions into human hair are also provided.

SUMMARY OF THE INVENTION

The present invention is directed to a method of installing a pre-assembled hair extension in the hair of a wearer, the method comprising the steps of: forming a part in the hair of the wearer to create a section; placing the pre-assembled hair extension near the part formed in the hair of the wearer, the pre-assembled hair extension comprising: a band having a front side and a back side; a first weft of extension hair attached to either the front side or the back side of the band, or both; a plurality of micro links attached to either the front side or the back side of the band, wherein at least one of the plurality of micro links forms an exterior surface and an annulus adapted to receive a wearer's natural hair; a second weft of extension hair, independent of the first weft of the extension hair, the second weft of extension hair being attached to the at least one of the plurality of micro links, wherein the exterior surface of the at least one of the plurality of micro links is fully wrapped with a material for receiving the second weft of extension hair on the exterior surface of the at least one of the plurality of micro links so that the second set of extension hair fully covers the exterior surface of the at least one of the plurality of micro links and substantially conceals the at least one of micro link with the second set of extension hair.

The present invention further is directed to a method of installing a pre-assembled hair extension in the hair of a wearer, the method comprising the steps of: forming a part in the hair of the wearer to create a section; placing the first pre-assembled hair extension near the part in the hair of the wearer, the first pre-assembled hair extension comprising: a micro link having an exterior surface that is fully wrapped with a material for receiving a weft of extension hair on the exterior surface of the micro link so that the weft of extension hair fully covers the exterior surface of the micro link and substantially conceals the micro link with the weft of extension hair.

Finally, the present invention is directed to a method of installing a pre-assembled hair extension in the hair of a wearer, the method comprising the steps of: forming a part in the hair of the wearer to create a section; placing the pre-assembled hair extension near the part formed in the hair of the wearer, the pre-assembled hair extension comprising: a first band having a front side and a back side; a first weft of extension hair attached to the front side or the back side of the first band, or both; a second band having a front side and a back side; a plurality of micro links attached to either the back side of the first band or the back side of the second band, or both, wherein at least one of the plurality of micro links forms an exterior surface and an annulus adapted to receive a wearer's natural hair; a second weft of extension hair, independent of the first weft of the extension hair, the second weft of extension hair being attached to the at least one of the plurality of micro links, wherein the exterior surface of the at least one of the plurality of micro links is fully wrapped with a material for receiving the second weft of extension hair on the exterior surface of the at least one of the plurality of micro links so that the second set of extension hair fully covers the exterior surface of the at least one of the plurality of micro links and substantially conceals the at least one of micro links with the second set of extension hair; wherein the back side of the first band and the back side of the second band are secured together to conceal the plurality of micro links therebetween.

DETAILED DESCRIPTION OF THE INVENTION

Figure 1:
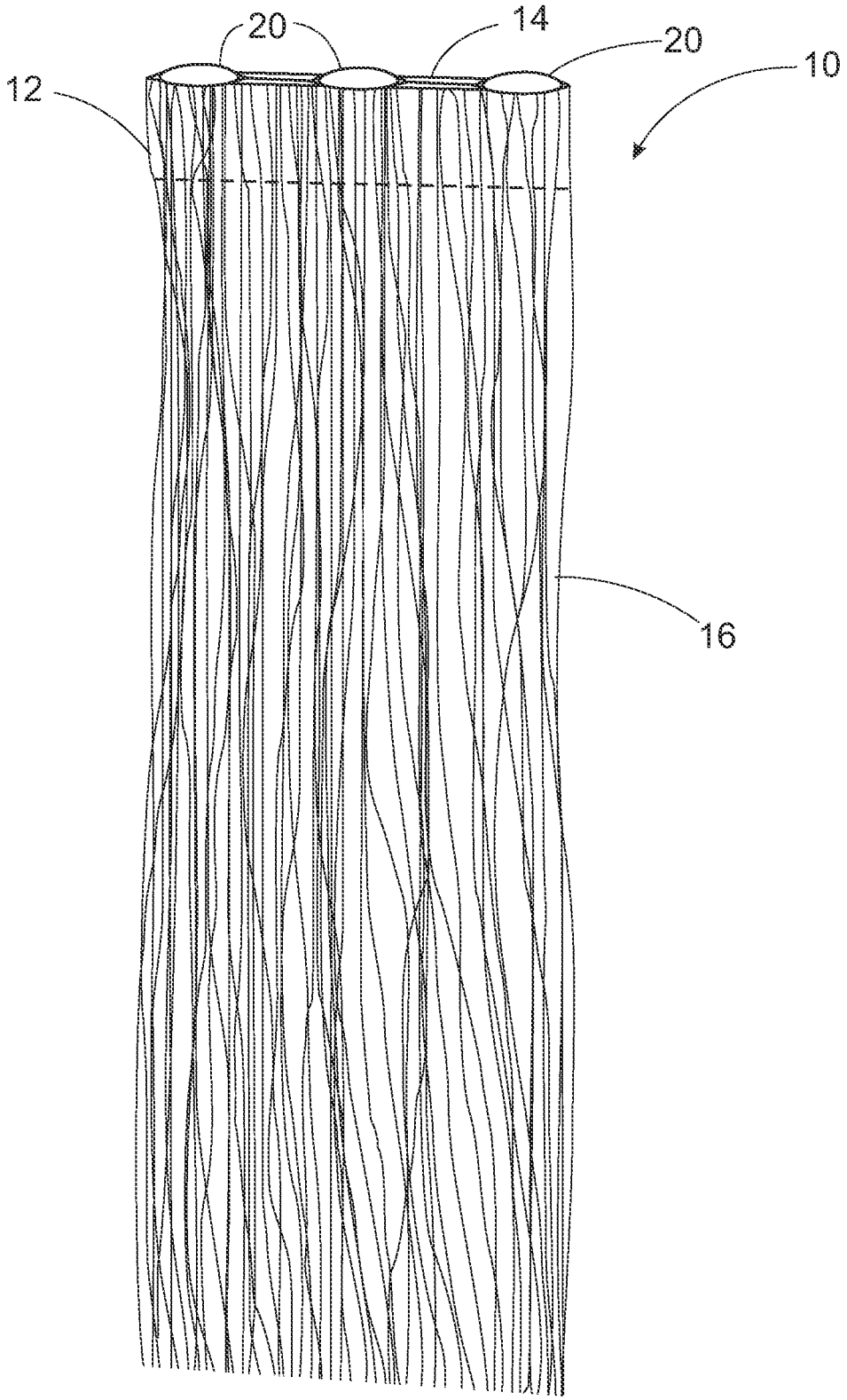
FIG. 1 is a perspective view of an embodiment of an exemplary hair extension constructed in accordance with the present invention.

Hair integrations, also known as hair extensions, are advantageous for achieving a desired appearance and for healthy bodily functioning and self-image. Individual identity and personality are reflected in one's hair. Cancer patients and those persons suffering from alopecia or other illnesses impacting the integumentary system benefit from hair extensions, which function to help regulate body temperature and protect against disease. Hair extensions, thus, serve useful and necessary purposes, not only for achieving beauty aspirations, but for overall health, maintenance and well-being.

Hair extensions have evolved over the decades since their introduction. Pinchbraid extensions are individual locks or wefts of hair that are tied into the wearer's natural, or native, hair with a thread. Tape-in hair extensions are attached to a layer of tape, which is then adhered with liquid adhesive or glue tape to the wearer's hair or scalp. These extensions must be washed with non-sulfate shampoos and other specialized products. The extensions are removed by applying glue remover. These types of hair extensions present risk of alopecia, damage to the hair root and may cause pain or discomfort. Tape-in hair extensions prohibit the application of heat. Moreover, some sources claim the application of adhesives directly to the human scalp or hair present health hazards.

Bonding involves the application of specialized adhesives, which bond the extension weft to the wearer's natural hair. Extensions applied with bonding glue should be worn for several weeks. A soft bond adhesive is flexible and comfortable to wear and is made using latex or acrylic based adhesives. Hard bond adhesives contain cyanoacrylate and last longer because they are not water-based and are less susceptible to deterioration. Hard bond adhesives, once applied, are unyielding and uncomfortable. Additionally, routine cleansing of the hair can deteriorate both the soft and hard bond adhesives and shorten the life of the extensions. Bonding also prohibits the application of heat to the extension.

Clip-in hair extensions typically do not cause damage or pain and may be integrated into natural hair to add length and volume on a temporary basis. Clip-in hair extensions generally are constructed as a single, long contoured extension that may be cut into multiple layers for creating separate layers when installed. Starting at the nape of the neck, the hair is sectioned and the extension, or weft, is placed onto this section with the clips open and facing the scalp. Each clip is snapped into place. Clipped-in extensions look less natural, although this technique also lacks the disadvantages of damage to the hair root and traction alopecia associated with glue extensions.

For a very natural look, fusion involves the application of hot glue to attach the extensions to individual strands of the wearer's natural hair, in very small sections. The process of installing fusion extensions is very time-consuming and requires re-positioning of the extensions every few months as the wearer's natural hair grows. To reduce the installation time, fusion attachments may comprise an adhesive tip, to which a heat clamp is applied to melt the adhesive to attach the extension to the natural hair. Fusion weaving of hair extensions permits routine shampooing and the use of hair products. Due to various chemicals in the adhesives, which may cause hair loss and scalp irritation, particularly when combined with heat, fusion is damaging to natural hair.

Micro links comprise strands of hair which are enclosed by small metal tubes. Micro links, also known micro beads, micro rings or micro loops, are small metal rings, tubes or beads attached to small sections of natural hair, then tightened using a special tool, or plier, that clamps the loop around the natural hair. Micro links are designed to be small so as to reduce visibility in the hair, although they are still visible when the hair is parted. As the hair grows, the micro links move away from the scalp, requiring repositioning every few weeks.

Micro links are made of metal, usually aluminum or copper, to attach the extension hair to the wearer's native hair. Micro links are applied by sliding the wearer's native hair through the metal micro link, adding the extension weft, and then compressing the micro link closed with a special plier to compress the link and secure it to the wearer's own hair. Conventional micro links can slide off of oily, fine or thin hair. To alleviate this problem, micro links may also be made of clear plastic tubes, which are heated and sealed for a more secure hold for wearers with oily, fine or thin hair. The plastic tube of the micro link permits a firmer hold, without adhesive, and it can be removed easily with the help of an oil or acetone-based remover, unlike keratin or tape bonds that leave adhesive residue and are difficult to remove without damaging the hair.

Inasmuch as micro links do not employ heat or adhesives, these hair extensions cause less damage attributable to heat or chemical sources than do other methods and devices. However, micro links, when attached improperly, may damage the natural hair. The weight of the links may be uncomfortable, and the hard metal loops may cause pain or discomfort due to pressure on the scalp when the wearer is in a supine position or when resting the head against a surface. Micro links also may prevent or disrupt sleep. Moreover, when installed close to the scalp, metal micro links may produce pruritis or pain, particularly during the first few weeks of use. Finally, these metal rings may be difficult to remove by the wearer, and it is advisable to have a professional uninstall the micro links to minimize the risk of damage to the wearer's natural hair.

The present invention overcomes the disadvantages of conventional hair extensions and provides a hair extension that does not employ the use of adhesives or heat to the scalp or to the wearer's natural hair. The present invention comprises micro links that are cushioned against the scalp to protect the wearer's scalp and natural hair. The present invention minimizes the risks of pruritis and pain and mitigates damage to the hair root. Finally, the present invention offers the most natural looking option for attaching hair extensions using micro links so that they are undetectable.

The present invention comprises a plurality of bands or strips having hair extensions secured thereto with micro loops adhered between the plurality of bands or strips to enable attachment to the wearer's native hair. A first band comprising the hair extension has a front side, to which the extension weft is attached, and a backside, to which the micro links are attached with adhesive. Similarly, a second band comprising the hair extension has a front side, to which the extension weft is attached and a back side, to which micro links are attached. The two layers are sandwiched together with the respective back sides of the first and second strips of extensions facing each other so that a double-sided sandwich of extensions is formed around the micro links, with the extension hair exposed on the exterior of the device and the wearer's native hair concealed inside the micro link in the interior of the device. This sandwiched hair extension configuration arrives at the salon pre-assembled and ready for installation. The bands to which the micro links are attached, or the openings through which hair may be threaded, can be made from silk monofilament, polyurethane, hair lace, thin skin, gauze, mesh or sheer fabrics, or other materials and may be tinted to match the wearer's skin tone. The wearer's native hair is pulled through the micro links in the sandwich with a hook, after which the micro links is flattened or clamped, or heat sealing in the case of a plastic micro link, to complete the installation of each section of the sandwiched hair extension.

The use of a tip extension also may be employed before clamping or sealing the micro link. The tip extension helps counter slippage of the wearer's natural hair, creates fullness and volume and protects the wearer's natural hair by adding an extra measure of cushion inside the micro link.

Additionally, the present invention provides a non-metallic, soft mesh or fabric micro link having perforations or openings in the sidewalls of the micro link through which extension hair is secured. The wearer's native hair is pulled through an inner annulus of the micro link, thus concealing the micro link from view. The non-metallic micro link may be used as a standalone extension or coupled with the sandwiched hair extension to provide a full yet discrete head of extension hair.

Additionally, the present invention provides a hair extension comprising a micro link wrapped with a material to which a weft of hair is secured. The wearer's native hair is pulled through an inner annulus of the micro link, thus concealing the micro link from view. The wrapped micro link may be used as a stand-alone extension or coupled with the sandwiched hair extension to provide a full yet discrete head of extension hair. The stylist need only pull the wearer's hair through the interior of the micro link to attach the extension strand to the wearer's natural hair. The extension is removed by decompressing the micro link with pliers and removing the micro link from the hair.

One benefit provided by the present invention is the sandwiching of the two bands, which hides the micro links in the wearer's native hair and creates a more natural and desirable look. An additional benefit is that the hair extension of the present invention creates volume and density while discreetly camouflaging the extension. A third benefit is that the hair extension of the present invention may be installed speedily in much less time than required for installing conventional hair extensions, particularly conventional micro link extensions. A fourth benefit is that the present invention does not require the application of glue and adhesives directly to the wearer's hair or scalp, thus eliminating the risk of alopecia and hair damage. A fifth benefit is that the wearer may wash, condition, style and maintain their hair routinely and apply styling products.

Figure 2:
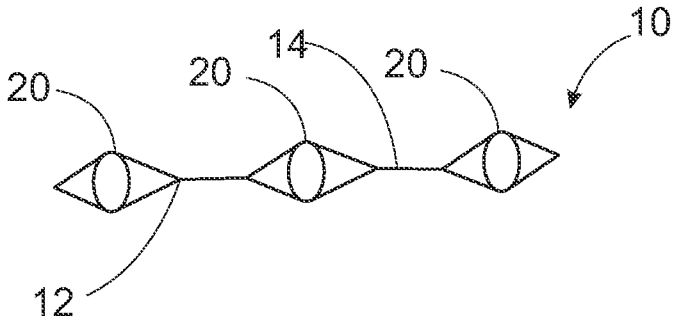
FIG. 2 is a top plan view of the hair extension of FIG. 1.

Turning now to the drawings in general, and to FIGS. 1 and 2 in particular, there is shown therein an exemplary hair extension 10 constructed in accordance with the present invention. As used herein, "hair extension" or "extension" means a weft of hair designed to be integrated into a wearer's natural hair to change the appearance of the wearer's natural hair. The hair extension 10 may make the wearer's hair appear longer, denser, voluminous, straight, curly, fine or course, or may impart other desirable properties. The extension 10 comprises at least one band, ribbon or strip 12 to which is attached a plurality of strands of hair comprising a weft of hair 16 extending distally therefrom in a manner yet to be described. In one embodiment of the invention, the extension 10 comprises a band, ribbon or strip 12 from which a weft of hair 16 extends distally therefrom.

Turning now to FIGS. 3A, 3B, 4A, and 4B, while one weft of hair 16 extending distally from extension band 12 may be sufficient for use in the extension 10, it will be appreciated that band 14 also may comprise a weft of hair 18 extending distally therefrom. The wefts of hair 16 and 18 may be any type of hair, including, without limitation, premium hair, synthetic hair, human hair, including Chinese, Indonesian, India, and European/Caucasian hair, virgin hair, raw hair, remy hair, cuticle remy hair, single drawn hair, and double drawn hair. The industry standard quality level of the wefts of hair 16 and 18 may range from 3A, being the lowest grade, to 10A, which is the highest grade. In one embodiment of the invention, the wefts of hair 16 and 18 in the hair extension 10 comprise human hair ranging in quality from level 6A through level 10A. Low grade hair tends to matt and tangle easily, while higher grade hair allows the wearer to experience easier maintenance and enables the wearer to wash, brush and style their hair regularly. Better quality hair also protects the wearer's native hair as the hair extensions 10 are brushed, washed and styled, while reducing tension on the wefts and minimizing effort needed to style the wefts since there is less pulling of hair from the scalp, thus reducing the risk of damage or actually plucking hair out.

The bands 12 and 14 are comprised of a thin material generally ranging in thickness from about 0.03 millimeters (approximately 0.0001 inches) to about 0.3 millimeters (approximately 0.012 inches). The length of the bands 12 and 14 generally range in length from about 6 millimeters (approximately 0.25 inches) to about 394 millimeters (approximately 15.5 inches). The height of the bands 12 and 14 generally range from about 6 millimeters (approximately 0.25 inches) to about 51 millimeters (approximately two inches). In one embodiment of the invention, the bands 12 and 14, are approximately 0.01 millimeters thick (approximately 0.004 inches thick), approximately 25.4 millimeters (approximately 1 inch) in length, and approximately 12.7 millimeters (approximately 0.5 inches) in height. It will be appreciated that, during the installation of the hair extension 10, bands 12 and 14 of different sizes may be utilized on various portions or sections of the head in a manner yet to be described.

Figure 3A:
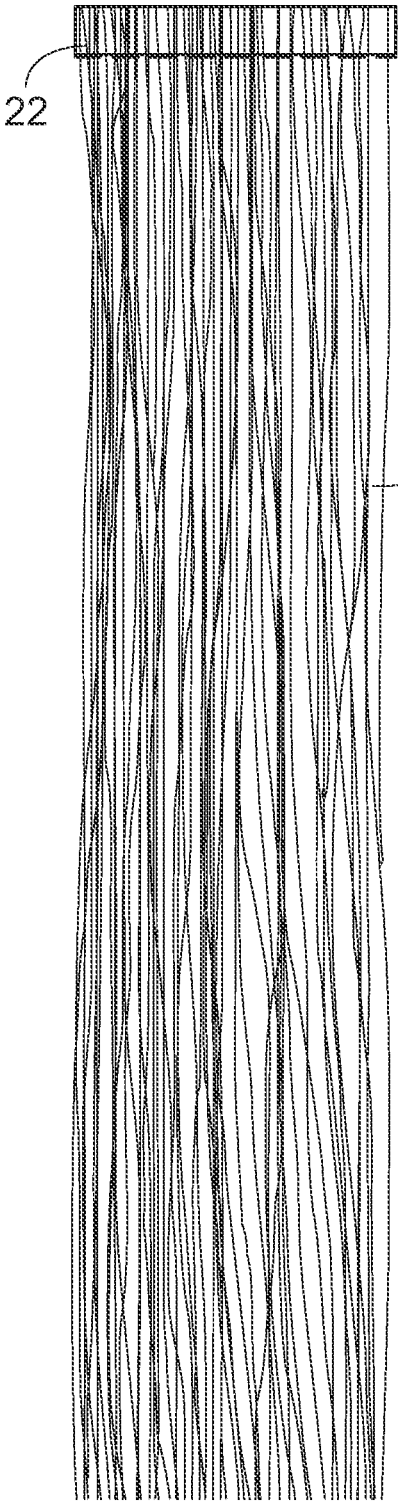
FIG. 3A is illustrates the front side of a first band comprising the hair extension of FIG. 1.
Figure 3B:
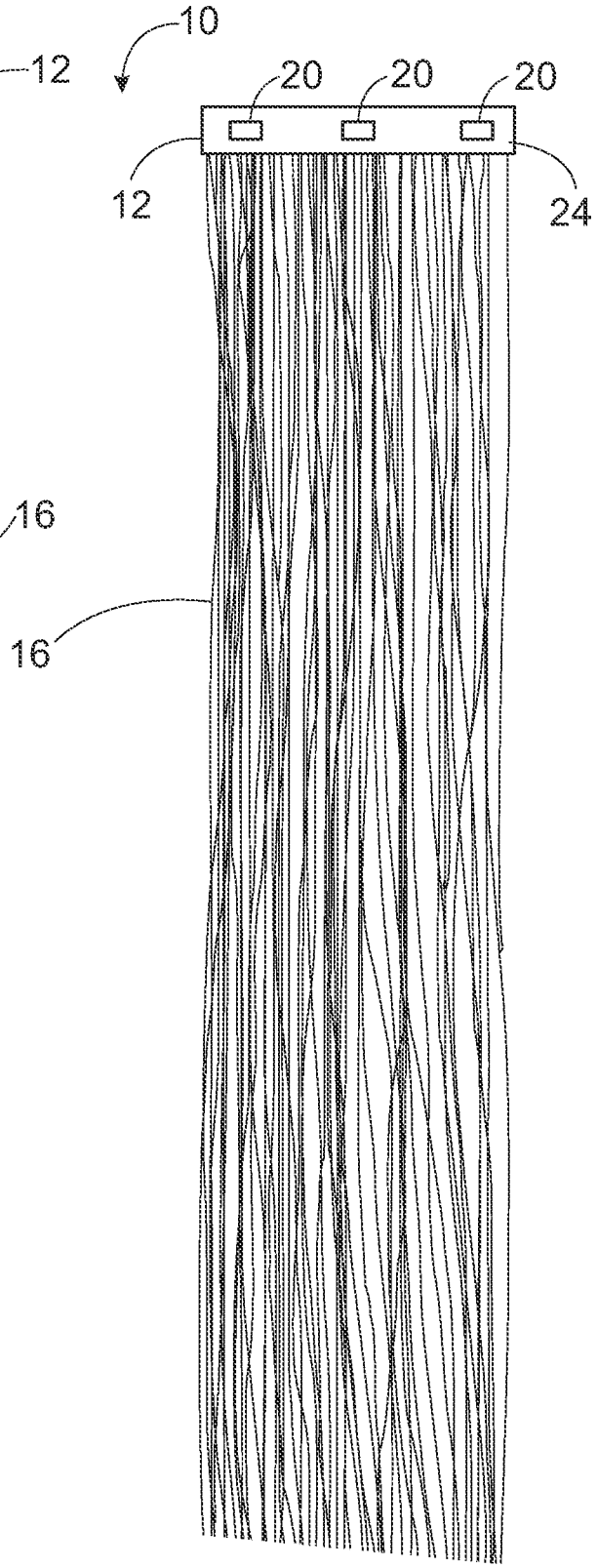
FIG. 3B is illustrates a back side of a first band comprising the hair extension of FIG. 1.
Figure 4A:
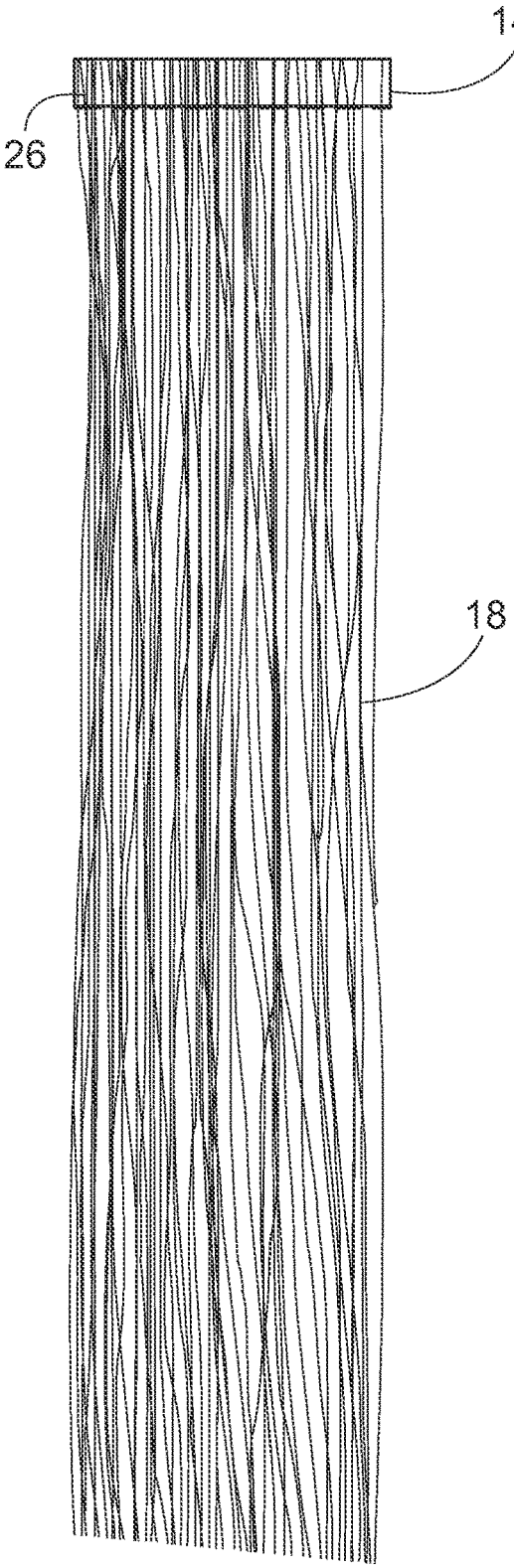
FIG. 4A illustrates a front side of a second band comprising the hair extension of FIG. 1.
Figure 4B:
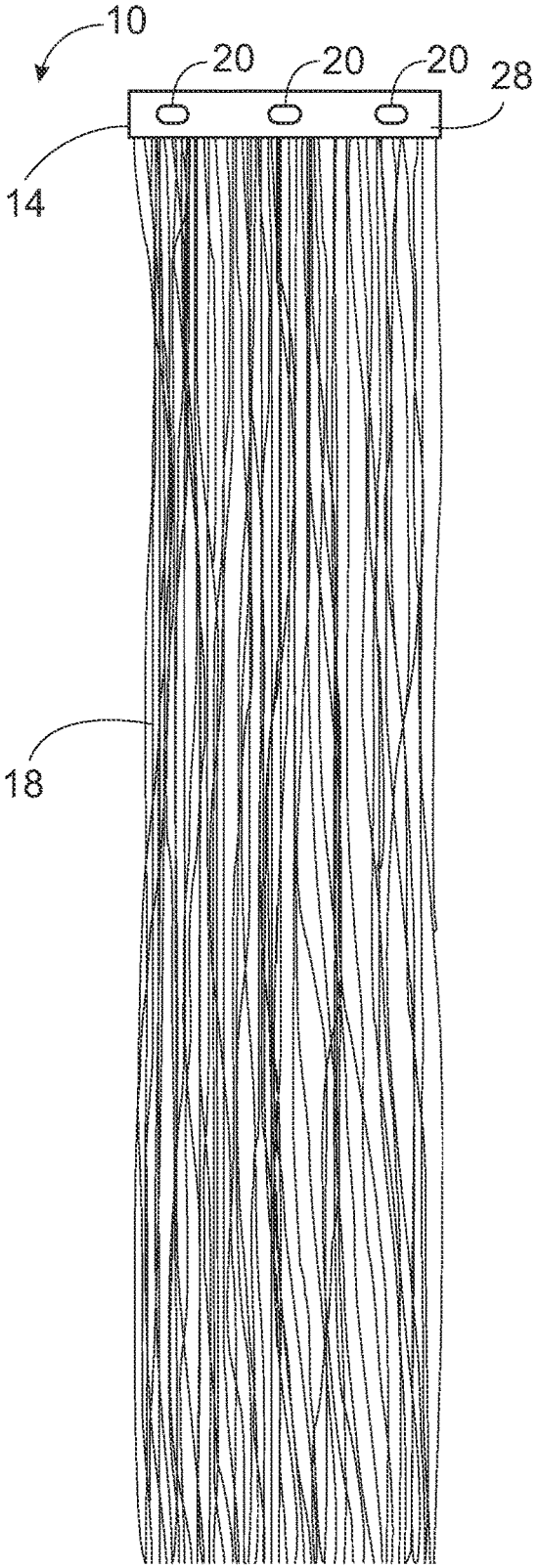
FIG. 4B is illustrates a back side of a second band comprising the hair extension of FIG. 1.

With continuing reference to FIGS. 3A and 3B, hair weft 16 may be attached to either the front side 22 of band 12 or the back side 24 of band 12. Additionally, as shown in FIG. 4A and 4B, hair weft 18 also may be attached either to the front side 26 of band 14 or the back side 28 of band 14, or both. For illustration purposes only, FIGS. 3A and 3B depict hair weft 16 attached to the front side 22 of band 12, and FIGS. 4A and 4B depict hair weft 18 attached to the front side 26 of band 14. Bands 12 and 14 are comprised of a material adapted to receive the wefts of extension hair 16 and 18. Bands 12 and 14 may be made of hair lace, polyurethane, thin skin, gauze, mesh, silk monofilament, silicone and sheer fabrics that blend with human hair and scalp. The material comprising bands 12 and 14 preferably will blend naturally into the wearer's hair and possess properties of both softness, durability, flexibility, wearability and comfort. The material comprising bands 12 and 14 preferability will not retain moisture, will look and feel realistic and will style easily.

Hair lace, also known as point tresse, is a form of bobbin and needlepoint lace made from human hair. The strands of hair comprising hair wefts 16 and 18 may be tied by hand into this sheer lace material. This allows the strands of hair comprising hair wefts 16 and 18 to move naturally from the bands 12 and 14 and creates a more natural looking transition from the scalp to the hair extension 10. Hair lace is naturally breathable and helps the wearer remain cool when hair extensions 10 are installed. Hair lace also imparts a natural appearance at the scalp line and enables the wearer to part the hair in different areas on the scalp. Hair lace enables natural hair movement and is softer on the scalp due to the sheerness of the lace material into which the extension hair is knotted.

Bands 12 and 14 also may be comprised of a polyurethane material. While some polyurethanes are thermosetting polymers, thermoplastic polyurethanes are available. In one embodiment of the invention, the polyurethane strip is a thermoplastic polymer that will permit the application of heat to style the hair, without loss of properties of the bands 12 and 14. Some examples of polymeric materials suitable for use to construct the bands 12 and 14 include epoxy, silicone, polyurethane and phenolic.

Bands 12 and 14 alternatively may be constructed of thin skin, which is a form of polyurethane that can be tinted, and may be black, light brown, medium brown, blonde, transparent or other colors to suit different skin tones and hair colors. After liquid polyurethane is used to coat lace or mono material, it is dried in special equipment creating a polyurethane base. This material is called thin skin in the industry.

The wefts of hair 16 and 18 are attached to the bands 12 and 14, respectively, in a variety of ways. The wefts of hair 16 and 18 may be tied by hand or machined into hair lace, polyurethane or thin skin or band 12 or 14 or may be secured with adhesive. By way of example, hair comprising wefts 16 and 18 may be injected by hand or machined into bands 12 and 14. A thin layer of adhesive is may be used to secure the wefts 16 and 18 in place on bands 12 and 14. Threads suitable for tying the wefts of hair 16 and 18 to bands 12 and 14 include human hair and polyester threads. Hair wefts 16 and 18 also may be secured to bands 12 and 14 by various knotting techniques, also known as ventilation. Knotting and injection methods include single reverse split knot, double reverse split knot, single flat knot, double flat knot, v-loop knot, normal injected hair, lift injected hair, double silk top, and single silk top.

Suitable adhesives for securing the wefts of hair 16 and 18 to bands 12 and 14 include cosmetic adhesives such as solvent-based adhesives, water-based adhesives, bis-aminopropyl diglycol dimaleate, acrylic-based adhesives, cyanoacrylate, latex adhesives, ethyl acetate-based adhesives, latex, silicone-based adhesives, polyurethane adhesive, polyvinyl acetate homopolymer, rubberized adhesive, and very high acrylic bond tape.

With continuing reference to FIGS. 3A and 3B and to FIGS. 4A and 4B, band 12 comprises a front side 22 and a back side 24, and band 14 comprises a front side 26 and a back side 28. Attached to the back side 24 of band 12 and/or the back side 28 of band 14 are a plurality of micro links 20. Micro links 20 are attached to either or both of the back sides 24 and 28 of the bands 12 and 14, respectively, with cosmetic adhesive adaptable for use in hair applications so that the micro links 20 are sandwiched therebetween. Some examples of cosmetic adhesives suitable for use in the present invention include solvent-based adhesives, water-based adhesives, bis-aminopropyl diglycol dimaleate, acrylic-based adhesives, cyanoacrylate, latex adhesives, ethyl acetate-based adhesives, latex, silicone-based adhesives, polyurethane adhesive, polyvinyl acetate homopolymer, rubberized adhesive, and very high acrylic bond tape.

When hair weft 16 is attached to the front side 22 of band 12 and/or hair weft 18 is attached to the front side 26 of band 14, it will be appreciated that the micro links 20 may be adhered either directly to the back side 24 of band 12 and/or the back side 28 of band 14, or both. Alternatively, when hair weft 16 is attached to the back side 24 of band 12 and/or the back side 28 of band 14, the micro links 20 will be secured therebetween with hair weft 16 and/or hair weft 18 or will be secured directly to the hair weft 16 and/or hair weft 18. In one embodiment of the invention, band 12 may comprise hair weft 16 that is ventilated or injected onto the front side 22 of band 12, and/or band 14 may also comprise hair weft 18 that is ventilated or injected onto the front side 26 of band 14, so that the hair wefts 16 and 18 are exposed exteriorly on the first band 12 and the second band 14. In another embodiment, band 12 comprises polyurethane tinted lace strip with hair weft 16 that is attached by suitable means such as adhesive on the back side 24 of band 12, and band 14 may also comprise hair weft 18 that attached by suitable means such as adhesive to the back side 28 of band 14, so that the hair wefts 16 and 18 are interposed interiorly of the assembled first band 12 and the second band 14 in a manner yet to be described.

The number and spacing of micro links 20 attached to back side 24 of band 12 and/or the back side 28 of band 14 are, at least in part, a function of the dimensions of the bands 12 and 14. As previously described, the dimensions of bands 12 and 14 may vary, based upon the particular application for the hair extension 10 and the location on scalp where the hair extension is to be installed.

Additionally, the number and spacing of micro links 20 attached to bands 12 and 14 depend upon the type of extension hair comprising hair wefts 16 and 18. It will be appreciated that the hair extension 10 is incorporated to impart desired properties of length or volume or to give the wearer's hair the characteristics of being straight, curly, fine, course, or other desirable properties. To that end, hair wefts 16 and 18 of the extension 10 may be curly or course, in which case, only two or three micro links 20 may be necessary. Alternatively, if significant volume or density is desired, the number of micro links adhered to the bands 12 and/or 14 will increase and the spacing therebetween will decrease, weaving a denser, more voluminous installation of hair wefts 16 and 18 into the wearer's natural hair.

The size of the micro links 20 may range from about 1.5 to about 5.5 millimeters (from about 0.059 to about 0.217 inches). The size of the micro links impacts the overall weight, the feel and the appearance of the hair extension 10. The micro links may be small enough to mimic a surgical hair transplant. The wearer or stylist, when installing the hair extension 10, should determine the appropriate size or sizes of extensions 10 to be used for the application, including the sizes of micro links 20 best suited for the wearer's hair length and texture and their health and cosmetic goals.

Figure 5A:
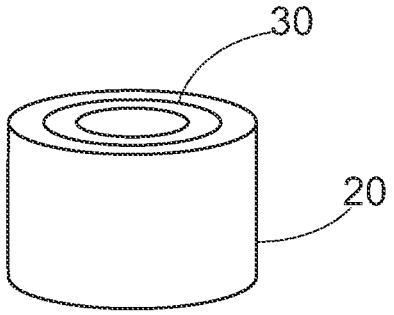
FIG. 5A is a perspective view of an exemplary micro link suitable for use in the hair extension of the present invention.
Figure 5B:
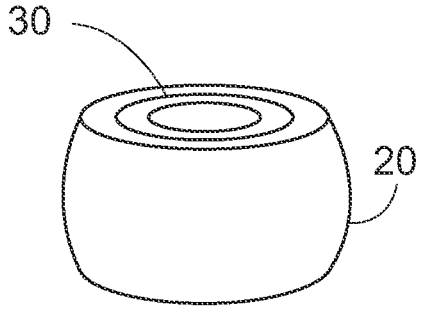
FIG. 5B is a perspective view of an alternative exemplary micro link suitable for use in the hair extension of the present invention.

Turning now to FIGS. 5A and 5B, in one embodiment of the invention, micro links 20 are generally cylindrical or tubular as shown in FIGS. 3B and 5A but may also be bead shaped as shown in FIGS. 4B and 5B. It will be appreciated that the micro links 20 may be any shape; however, a smooth geometry with a minimum of angles is more comfortable for the wearer and mitigates the risk of damage to the hair wefts 16 and 18 and the wearer's native hair.

Micro links 20 may be made of metals, such as aluminum or copper, or of plastics, and may incorporate a thin non-slip layer 30 in the interior of the micro link 20 to enhance cushioning and increase grip of the micro link on the hair. Additionally, micro links 20 may be made of plastic tubes, which are pressed with a heated tip tool to seal but not melt the micro links.

The micro links 20 may be various colors to match different hair tones, such as clear, transparent, black, blonde, dark blonde, light brown, dark brown, brunette or red. Micro links 20 may be vary in size as needed for different applications, areas of the head and hair thicknesses, and may be small from about 2.5 millimeters (about 0.1 inches) in outer diameter, 1.5 millimeters (about 0.06 inches) in inner diameter and about 2 millimeters (about 0.8 inches) in height. For larger micro links 20, the size may be about 4.0 millimeters (about 0.16 inches) in outside diameter, about 3.0 millimeters (about 0.12 inches) inside diameter and 6.0 mm (about 0.24 inches) in height. In one embodiment of the invention, the micro link 20 is 5 millimeters (about 0.2 inches) in outside diameter, 3 millimeters (about 0.12 inches) in inside diameter and 3 millimeters (about 0.2 inches) in height.

Micro links 20 may be interiorly lined with a lining 30 made of silicone-base material or other compounds that have properties that will protect the wearer's natural hair when it is pulled through the micro link and after the hair is secured within the micro link. Silicones suitable for use in the present invention include dimethicone, aminosilicones, siloxysilicates and anionic silicones. These compounds differ in their rates of deposition and solubility in a water medium and act differently on or in the hair. Some silicones are heat resistant and also enhance the shine of hair by reflecting the light. Dimethicone has the effect of protecting the hair shaft from abrasive actions while siloxysilicates increase hair body. Polysiloxane polymers may re-cement lifted cuticle scales and prevent damage from heat. Amino functional silicones are cationic substances but are not necessarily more substantive to the hair than dimethicone. Dimethicones are hydrophobic and have enhanced adsorption properties on virgin hair and roots. Other possible polymers for interiorly lining the micro links 20 include polypeptides, which are substantive to the hair and have ionic and polar sites for bonding and attaching to the hair surface. Protein hydrolysates, in particular those with low molecular weight distribution, have been known to protect hair against chemical and environmental damage. Many types of protein hydrolysates, such as keratin hydrolysates, neutralize electrical charges and diminish frizz and friction. Keratin is a useful protein due to its mechanical and protective properties. It will be appreciated that the micro links 20 may also be lined on the exterior surface to provide added cushioning and other benefits. The use of a tip extension also may be employed before clamping or sealing the micro link 20. The tip extension helps counter slippage of the wearer's natural hair, creates fullness and volume and protects the wearer's natural hair by adding an extra measure of cushion inside the micro link.

It now will be appreciated that the subject invention comprises a first band 12 having a front side 22 and a back side 24 and a second band 14 having a front side 26 and a back side 28. Hair weft 16 may be attached to either the front side 22 or the back side 24 of band 12, and hair weft 18 may be attached to either the front side 26 or the back side 28 of band 14, or both. Micro links 20 are attached therebetween either directly to the back sides 24 and 28 of bands 12 and 14, respectively, or to hair weft 16 and/or 18 secured therebetween. Band 12 may comprise only the hair weft 16 on the front side 22 or the back side 24 and no micro links 20 on the back side 24. Band 14 may comprise only micro links 20 on back side 28, and omit hair weft 18 from either the front side 26 or the back side 28. The two bands 12 and 14 are secured together with the respective back sides 24 and 28 of the band 12 and the band 14 facing each other so that a double-sided sandwich of extensions is formed around the micro links 20, with the extension hair 16 and 18 exposed either on the exterior of the extension 10 on front side 22 of band 12 and front side 26 of band 14, or with the hair wefts 16 and 18 interposed between the back sides 24 and 28 with the micro links 20. In one embodiment of the invention, the wearer's native hair is concealed inside the micro links 20 between the back sides 24 and 28 of the bands 12 and 14, in the interior of the assembled hair extension 10, thus concealing the micro links.

The back side 24 of band 12 and the back side 28 of band 14 are secured together with cosmetic adhesives or thread adaptable for use in hair applications. Some examples of cosmetic adhesives suitable for use in the present invention include solvent-based adhesives, water-based adhesives, bis-aminopropyl diglycol dimaleate, acrylic-based adhesives, cyanoacrylate, latex adhesives, ethyl acetate-based adhesives, latex, silicone-based adhesives, polyurethane adhesive, polyvinyl acetate homopolymer, rubberized adhesive, and very high acrylic bond tape.

Figure 6A:
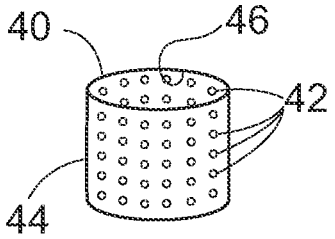
FIG. 6A is a perspective view of an alternative exemplary micro link suitable for use in the hair extension of the present invention.
Figure 6B:
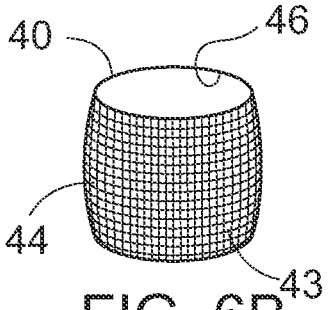
FIG. 6B is a perspective view of an alternative exemplary micro link suitable for use in the hair extension of the present invention.

In another embodiment of the invention, shown in FIGS. 6A and 6B, an alternative micro link 40 comprises a cylindrical or tubular shape constructed of a compressible or mesh material having openings or perforations 42 therein or a micro link 40 wrapped with a material 43 on the exterior 44 of the micro link. Materials 43 suitable for use in wrapping the micro link 40 include hair lace, polyurethane, thin skin, gauze, mesh, silk monofilament, silicone and sheer fabrics that blend with human hair and scalp.

Figure 7A:
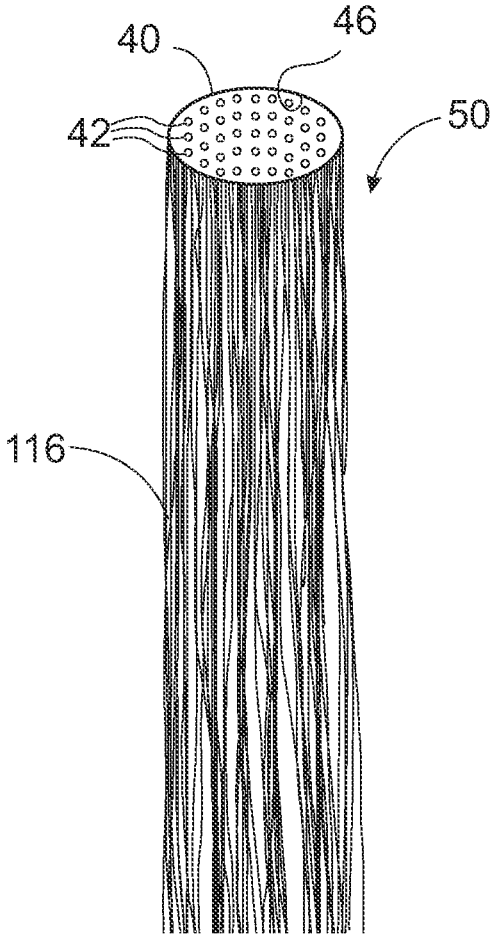
FIG. 7A illustrates an alternative hair extension comprising the micro link of FIG. 6A, assembled with a weft of hair and operational for installation.
Figure 7B:
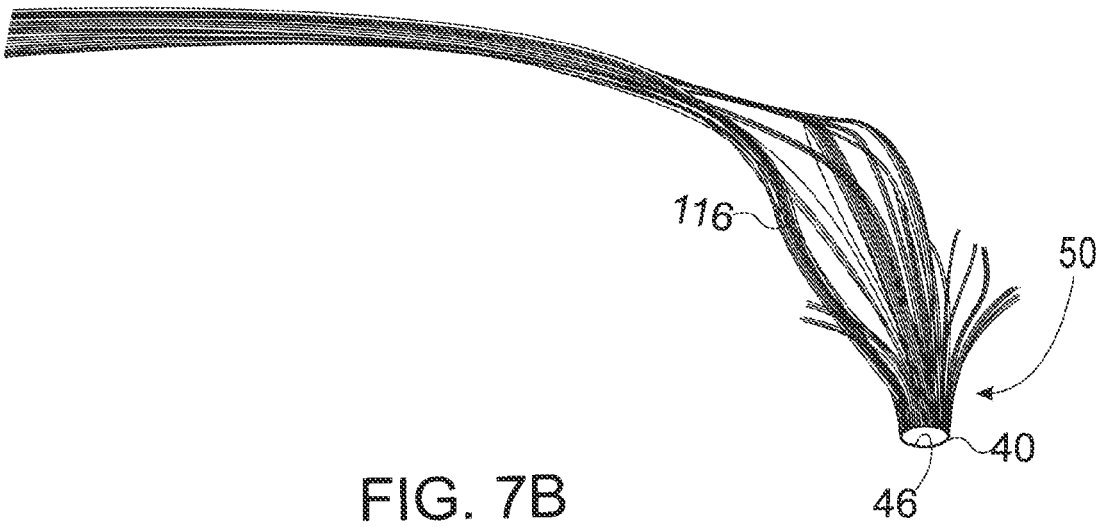
FIG. 7B illustrates an alternative hair extension comprising the micro link of FIG. 5A, assembled with a weft of hair and operational for installation.

As shown in FIG. 7, strands or wefts of extension hair 116 attach to an exterior surface 44 of the cylindrical micro link 40 or to an annulus or interior 46 either by wrapping hair extension 116 around and securing to material 43 on the exterior surface 44 and securing to the micro link 40 or by pulling through openings, mesh or perforations 42. Extension hair 116 is secured to micro link 40 on either the exterior surface 44 and/or the interior surface 46 with adhesive or threads or pulled through the openings 42. The extension hair 116 conceals the micro link 40. The wearer's native hair is drawn through the annulus or interior 46 of the micro link 40, after which the micro link is compressed with a plier or other tool to hold the extension hair 116 in place. The wearer's native hair is pulled into or through the interior 46 of the micro link 40, thus camouflaging the micro link and creating an undetectable hair extension. By wrapping the hair weft 16 around the exterior surface 44 of micro link 40, or pulling through perforations 42, the micro link 40 is disguised and gives the appearance of a natural hair strand.

Within the annulus or interior 46, micro link 40 may also comprise a liner 30 made of silicone-base material or other compounds having properties that will protect the wearer's hair when it is pulled through the micro link and after the hair is secured within the micro link, as hereinabove described.

The micro link 40 may be use as a stand-alone extension 50 and attached directly to a wearer's natural hair. The micro link 40 is small and remains concealed. Moreover, the micro link 40 is lightweight, compressible and comfortable, creating a pain-free experience, which is a distinct advantage over conventional metal micro links.

Figure 8A:
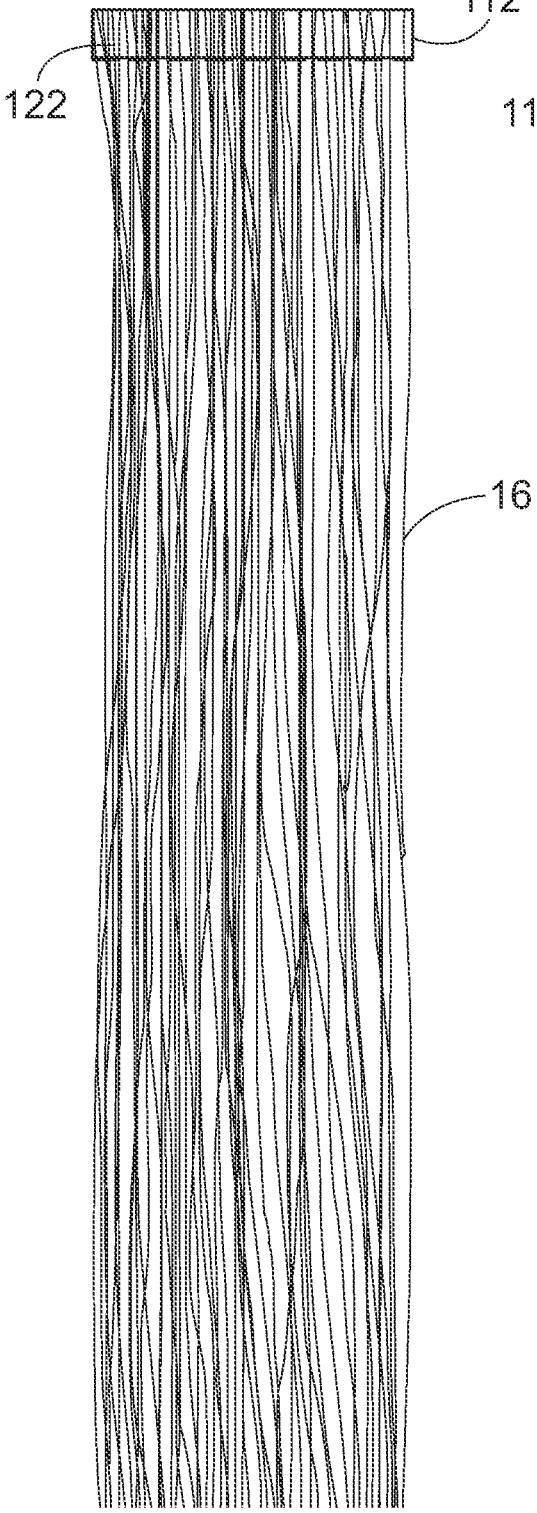
FIG. 8A illustrates a front side of a first band comprising the hair extension of FIG. 7A or 7B.
Figure 8B:
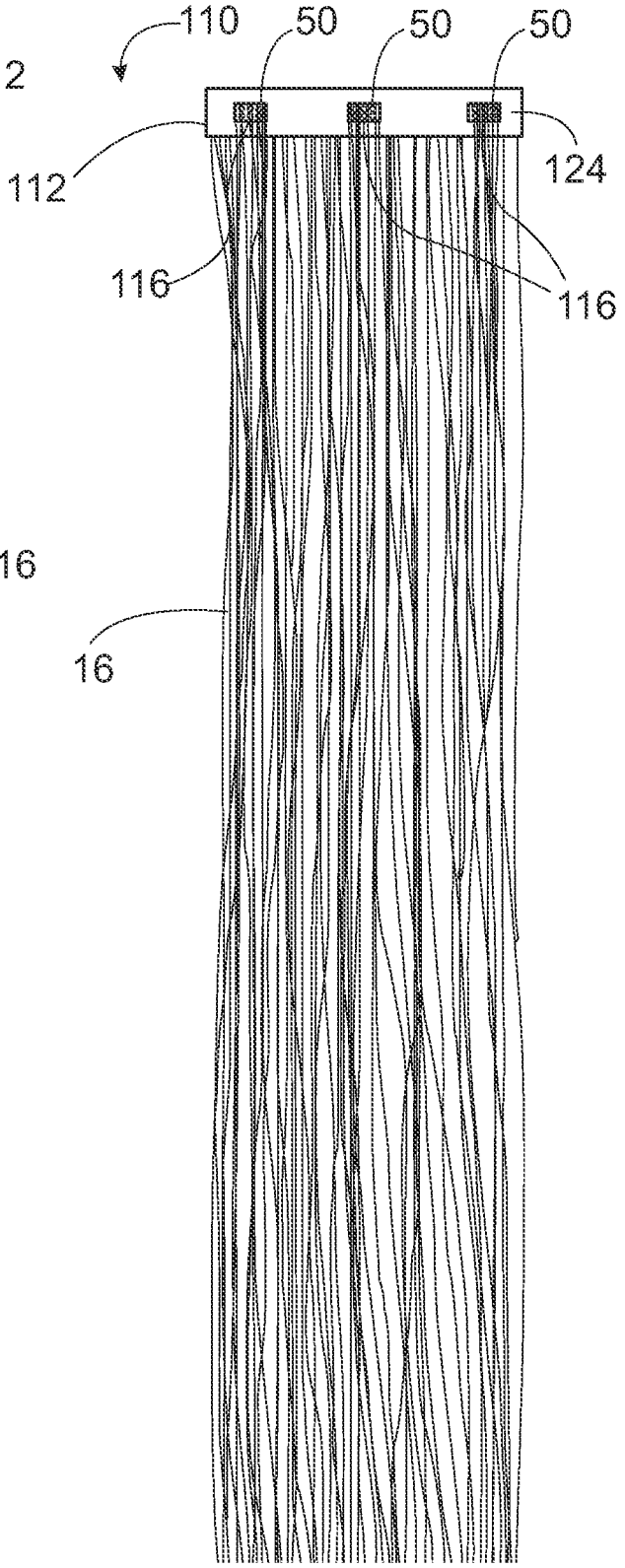
FIG. 8B illustrates a back side of a first band comprising the hair extension of FIG. 7A or 7B.
Figure 9A:
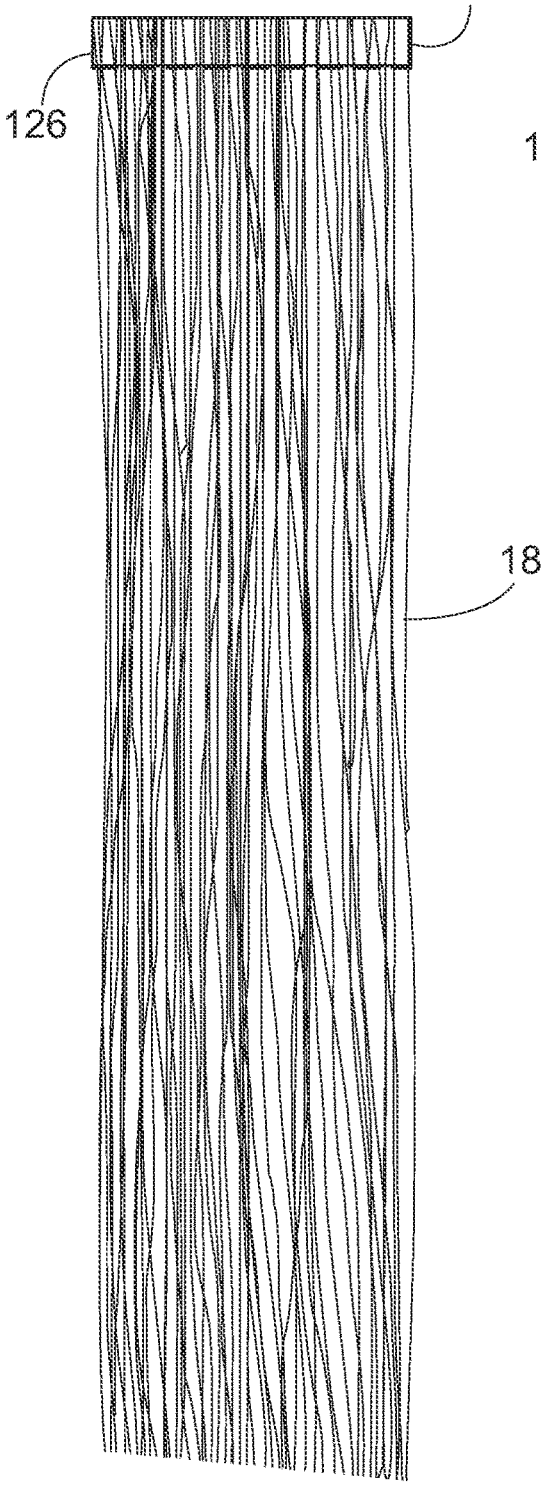
FIG. 9A illustrates a front side of a second band comprising the hair extension of FIG. 7A or 7B.
Figure 9B:
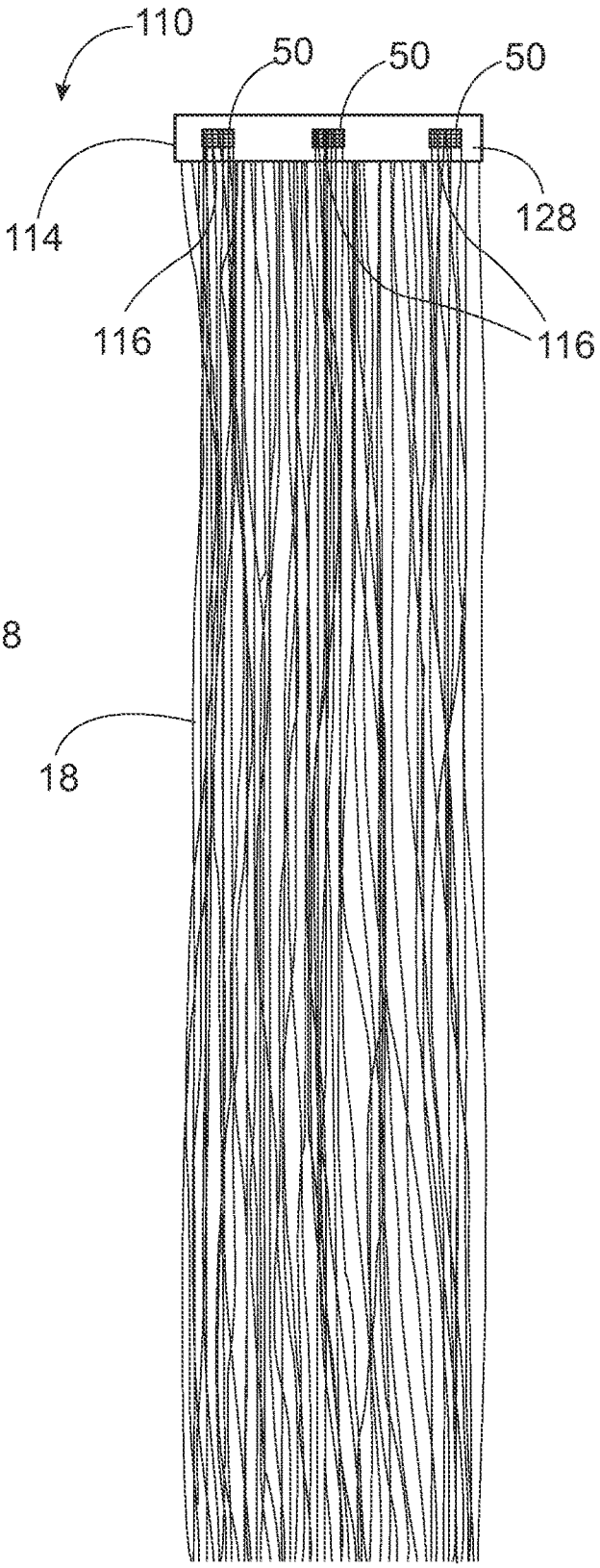
FIG. 9B illustrates a back side of a second band comprising the hair extension of FIG. 7A or 7B.
Figure 10:
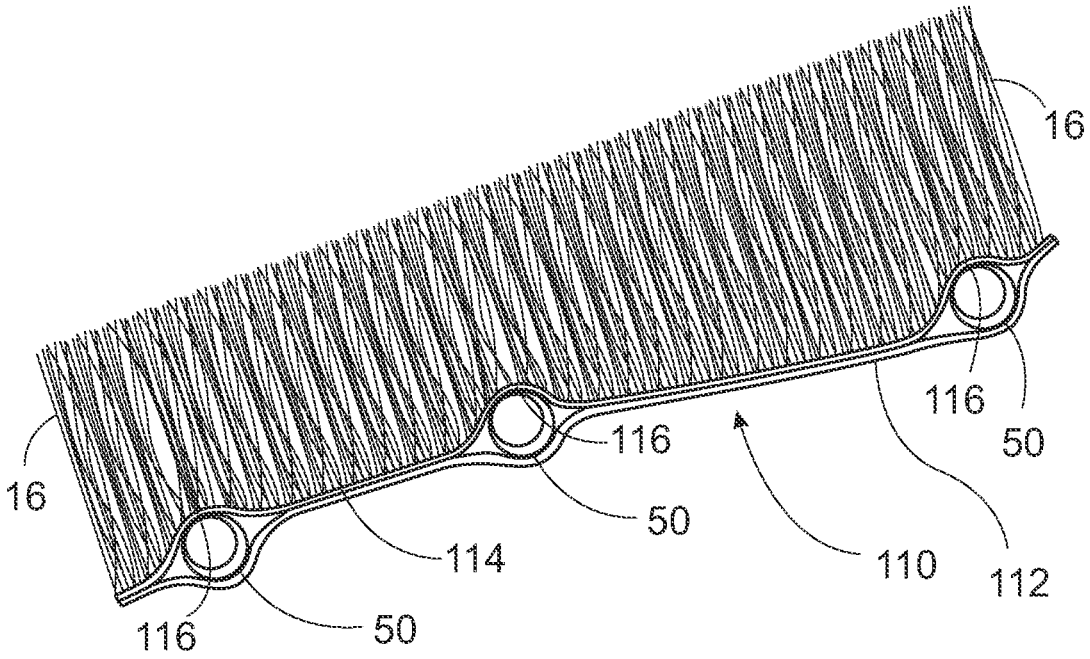
FIG. 10 is a top plan view of the assembled hair extension of the present invention comprising the bands of FIGS. 8A and 8B and the bands of FIGS. 9A and 9B.
Figure 11A:
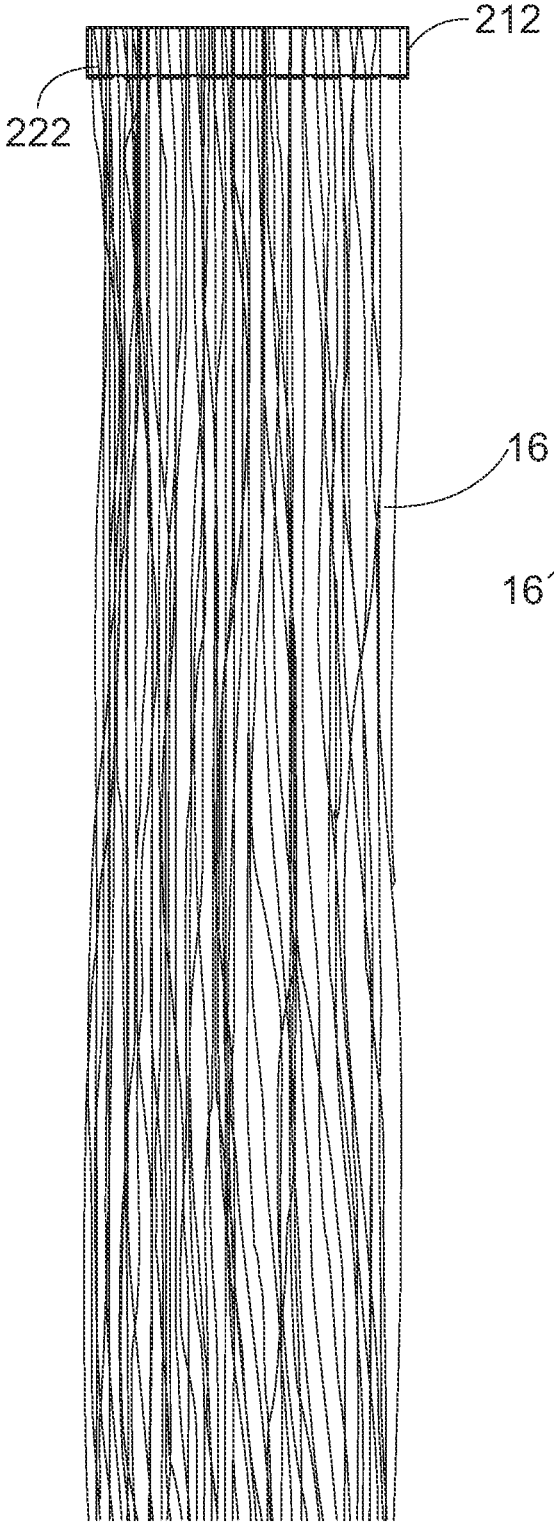
FIG. 11A illustrates a front side of a first band comprising an alternative embodiment of the hair extension of the present invention.
Figure 11B:
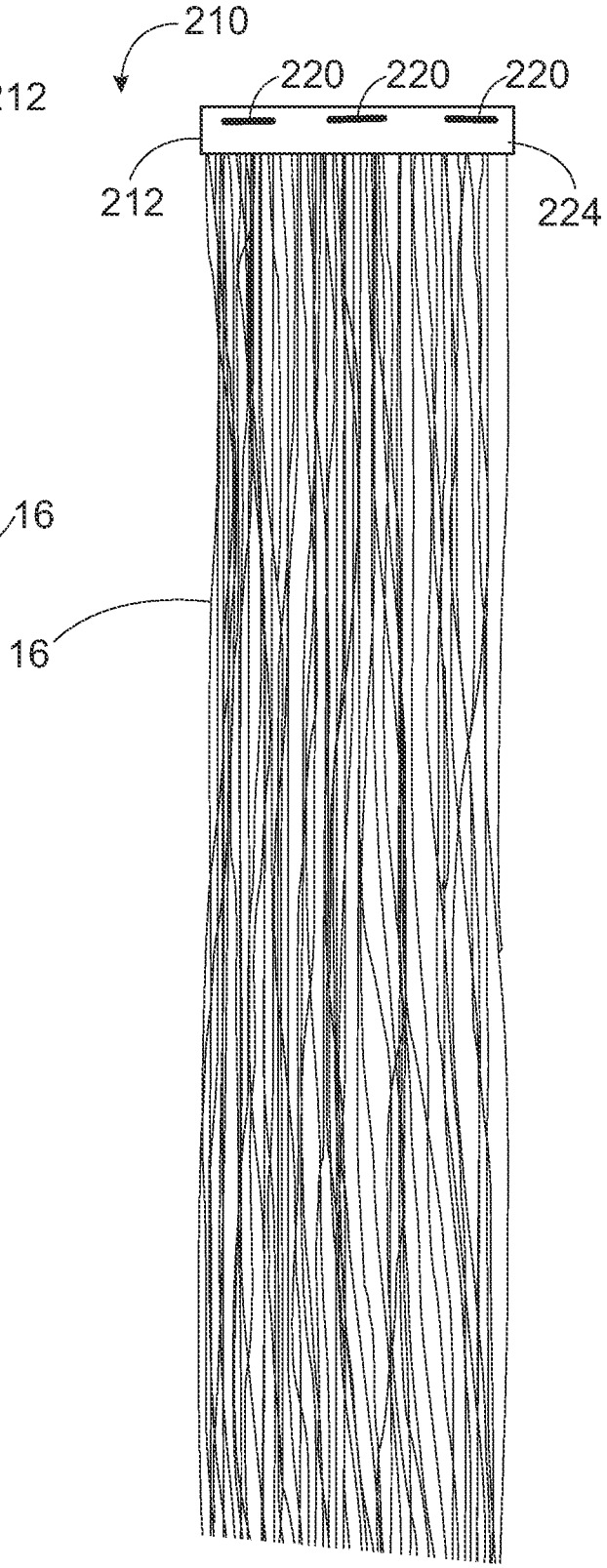
FIG. 11B illustrates a back side of the first band illustrated in FIG. 11A.
Figure 12A:
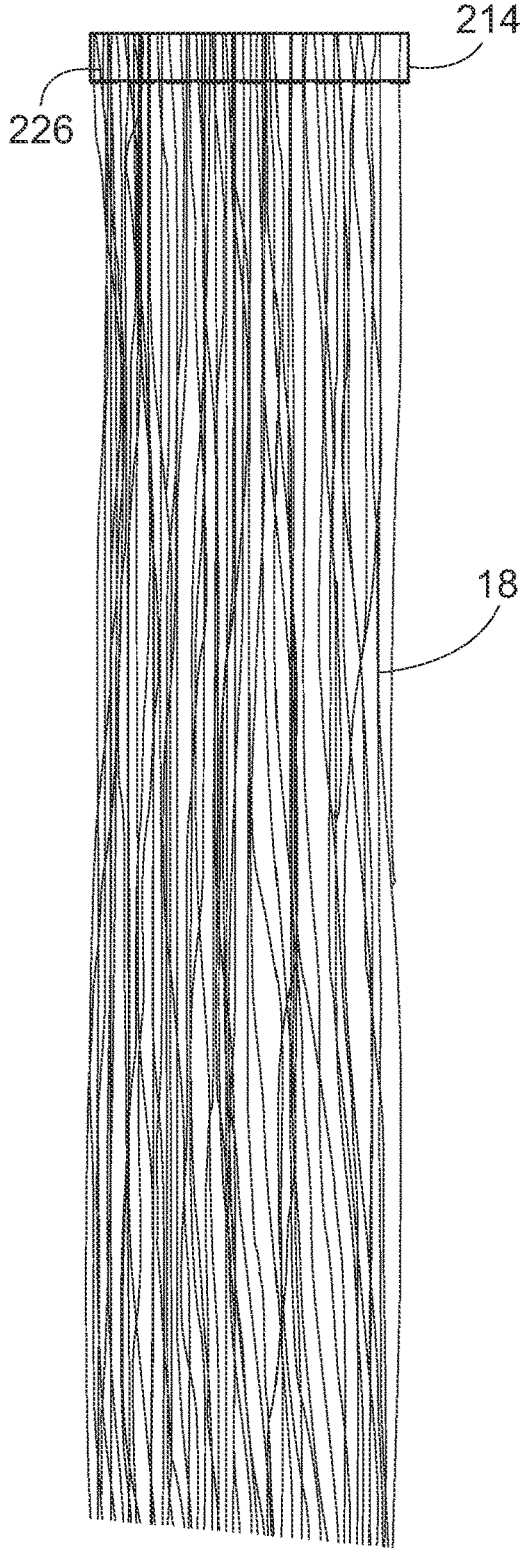
FIG. 12A illustrates a front side of a second band comprising an alternative embodiment of the hair extension of the present invention.
Figure 12B:
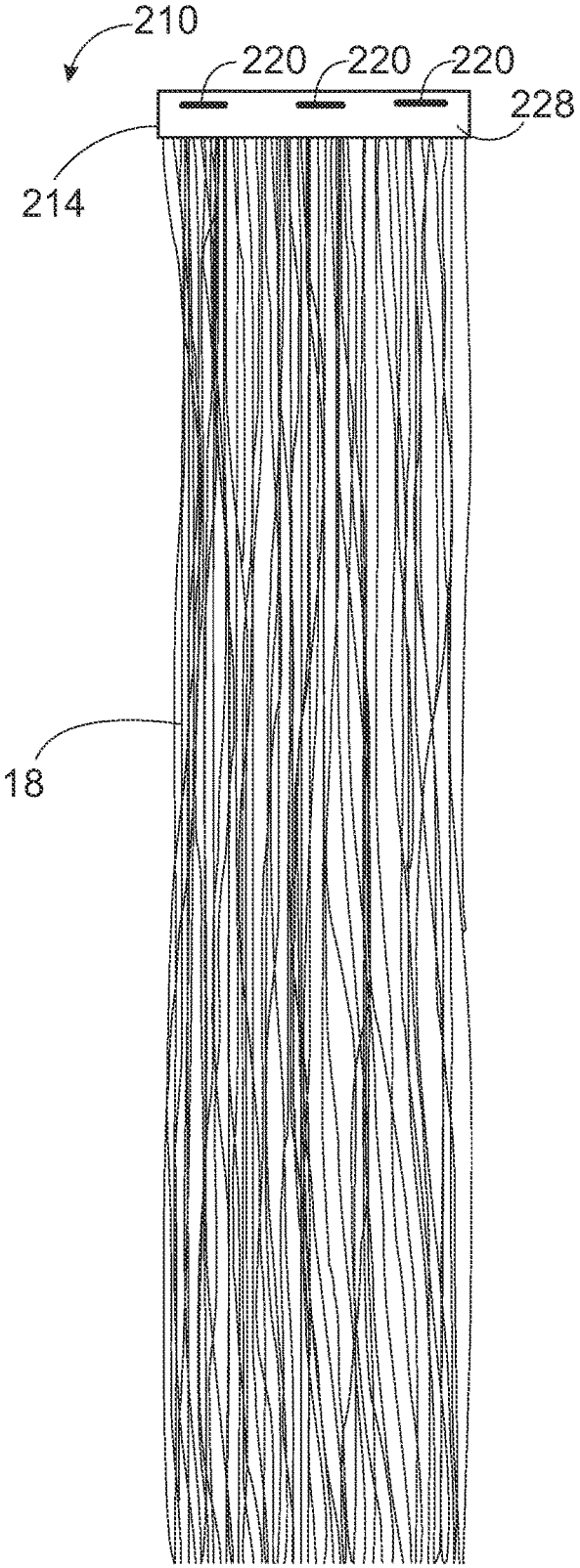
FIG. 12B illustrates a back side of the second band illustrated in FIG. 12A.
Figure 13:
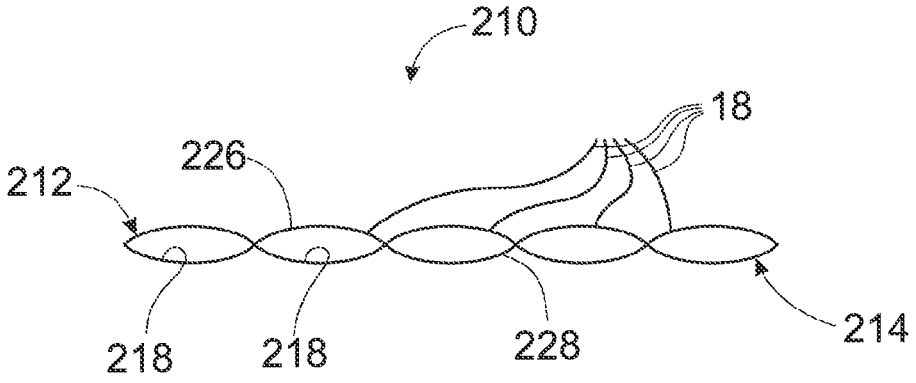
FIG. 13 is a top plan view of the assembled hair extension of FIGS. 11A, 11B, 12A and 12B.

Alternatively, as shown in FIG. 8A and 8B and in FIGS. 9A and 9B, hair extensions 50 may be used in conjunction with or in lieu of micro links 20 in bands 112 and 114 and interposed therebetween as heretofore described to create hair extension 110. As shown in FIGS. 8A and 8B, hair weft 16 may be attached to the front side 122 of band 112 and hair extension 50 attached to the back side 124 of band 112. It will be appreciated that hair weft 16 alternatively may be attached to the back side 124 of band 112. Additionally, as shown in FIG. 9A and 9B, hair weft 18 may be attached to the front side 126 of band 114 or the back side 128 of band 114, while hair extensions 50 may be attached to the back side 128 of band 114. As shown in FIG. 10, the two bands 112 and 114 are secured together with the respective back sides 124 and 128 of the band 112 and the band 114 facing each other so that a double-sided sandwich of extensions is formed around the hair extensions 50, while hair weft 116 of hair extension 50 extends therefrom, creating a denser, more voluminous and luxurious hair extension 110 that is lightweight and concealed. The hair wefts 16 and 18 either are exposed exteriorly on the front side 122 of band 112 and/or the front side 126 of band 114, or interiorly on the back side 124 of band 112 and/or the back side 128 of band 114.

Turning now to FIGS. 11A, 11B, 12A, 12B and 13, an additional embodiment of hair extension 210 is shown wherein band 212 comprises a front side 222 and a back side 224, and band 214 comprises a front side 226 and a back side 228. Hair weft 16 may be attached to the front side 222 of band 212 or the back side 224 of band 212 as hereinabove described. Additionally, hair weft 18 may be attached to the front side 226 of band 214 or the back side 228 of band 214 as hereinabove described. In lieu of micro links, openings or slits 218 are formed between the two assembled components 212 and 214 of hair extension 210. Additionally, openings or slits 220 are formed in the back side 224 of band 212 and/or the back side 228 of band 214. The back side 224 of band 212 and the back side 228 of band 214 are secured together with cosmetic adhesives or thread adaptable for use in hair applications as hereinabove described, leaving openings 218 therebetween in communication with openings 220 in bands 212 and 214. The wearer's native hair is threaded first through openings 218 in the top of the hair extension 210 and then through openings 220 in the bands 212 and 214, thus eliminating the need for micro links.

The width of openings 218 and 220 is at least in part, a function of the dimensions of the bands 212 and 214. As previously described, the dimensions of bands 212 and 214 may vary, based upon the particular application for the hair extension 210 and the location on scalp where the hair extension is to be installed. In one embodiment of the invention the openings 218 and 220 range from about 1.5 to about 5.5 millimeters in width (from about 0.059 to about 0.217 inches). The width of openings 218 and 220 may be the same or may vary, so that a larger section of the wearer's natural hair is pulled through an opening 218 but that same section may be threaded through multiple openings 220.

The number and spacing of openings 218 and 220 depend upon the type of extension hair comprising hair wefts 16 and 18. It will be appreciated that the hair extension 210 is incorporated to impart desired properties of length or volume or to give the wearer's hair the characteristics of being straight, curly, fine, course, or other desirable properties. To that end, hair wefts 16 and 18 of the extension 210 may be curly or course, in which case, only two or three openings 218 and two or three openings 220 may be needed. Alternatively, if significant volume or density is desired, the number of openings 218 and 220 will increase and the spacing therebetween will decrease, weaving a denser, more voluminous installation of hair wefts 16 and 18 into the wearer's natural hair. Hair extension 210 is lightweight, discrete, comfortable, seamless and easily camouflaged while providing a full, natural looking head of hair.

When hair weft 216 is attached to the front side 222 of band 212 and/or hair weft 218 is attached to the front side 226 of band 214, it will be appreciated that the micro links 20 may be adhered either directly to the back side 224 of band 212 and/or the back side 228 of band 214, or both. Alternatively, when hair weft 216 is attached to the back side 224 of band 212 and/or the back side 228 of band 214, the micro links 20 will be secured therebetween with hair weft 216 and/or hair weft 218 or will be secured directly to the hair weft 216 and/or hair weft 218. In one embodiment of the invention, band 212 may comprise hair weft 216 that is ventilated or injected onto the front side 222 of band 212, and/or band 214 may also comprise hair weft 218 that is ventilated or injected onto the front side 226 of band 214, so that the hair wefts 216 and 218 are exposed exteriorly on the first band 212 and the second band 214. In another embodiment, band 212 comprises polyurethane tinted lace strip with hair weft 216 that is attached by suitable means such as adhesive on the back side 224 of band 212, and band 214 may also comprise hair weft 218 that attached by suitable means such as adhesive to the back side 228 of band 214, so that the hair wefts 216 and 218 are interposed interiorly of the assembled first band 212 and the second band 214.

It will now be appreciated that the hair extensions 10, 50, 110 and 210 lie flat and seamless, which gives the appearance that the extension is growing directly from the roots of the wearer's head, while remaining concealed. The wearer may part their hair without revealing the discrete extensions 10, 50, 110 and 210 underneath. The invention lasts longer than conventional micro link extensions, even up to six months or more. The hair extensions 10, 50, 110 and 210 may be brushed, shampooed, conditioned and blow dried. Hair products may be applied to the hair extensions 10, 50,110 and 210.

Figure 14:
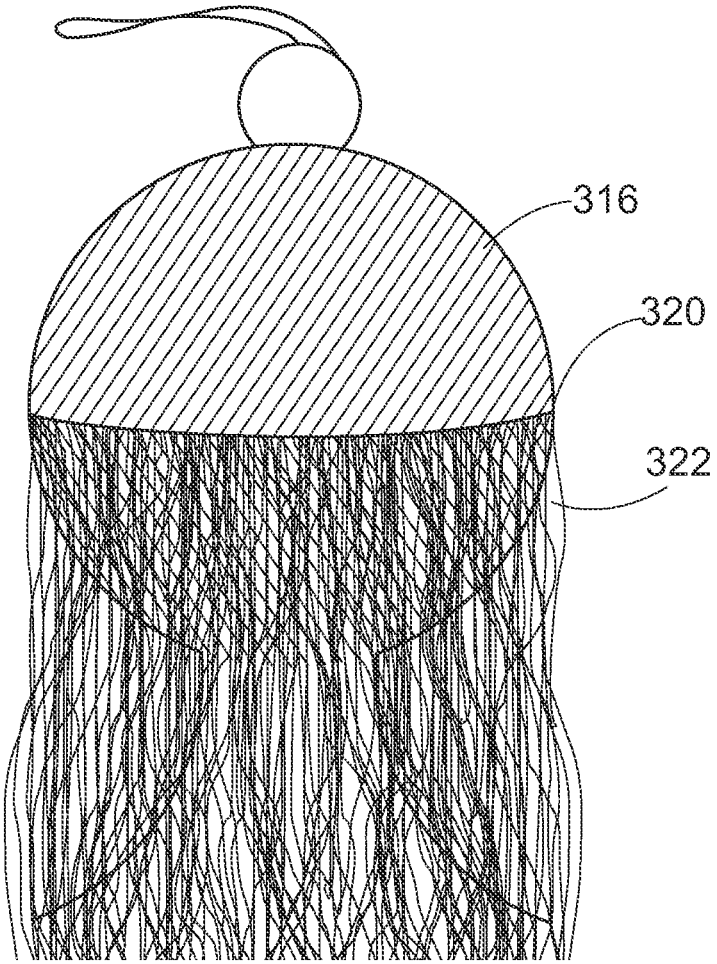
FIG. 14 illustrates a method of practicing the invention comprising the step of sectioning the hair prior to installation of the hair extension.
Figure 15:
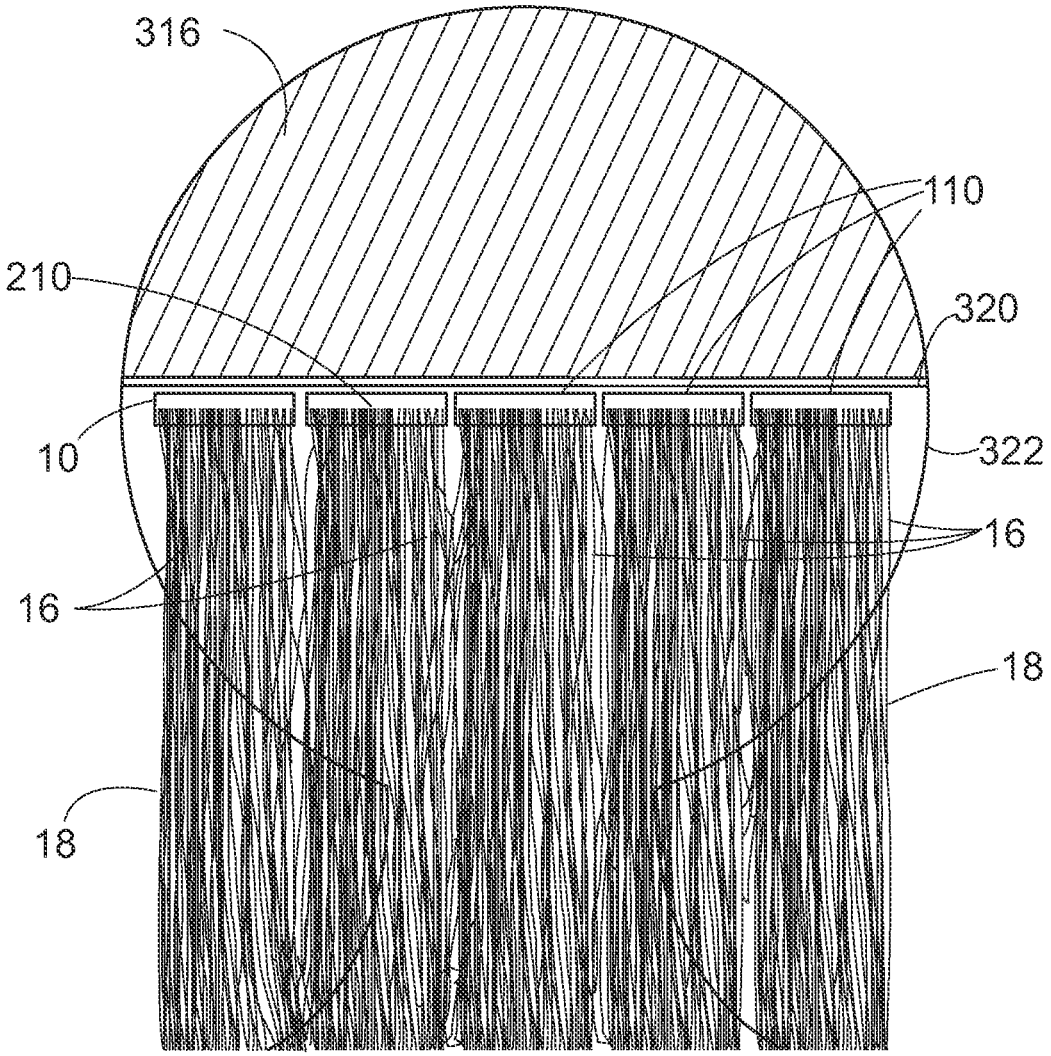
FIG. 15 illustrates a method of practicing the invention comprising the step of installing the hair extension of the present invention to the section of hair from FIG. 13.

Turning now to FIGS. 14 and 15, the method and operation of the present invention now will be explained. The foregoing discussion of the invention is incorporated herein. The wearer's natural hair 316 is parted 320 into sections 322 for installation of the extensions 10, 50, 110 and/or 210. Installation may begin, for example by horizontally parting the hair in the desired location on the scalp and applying the desired number of extensions in this section. A hair extension 10, 50, 110 or 210 is positioned proximal the scalp, and the wearer's natural hair is pulled through each micro link 20 or 40 in the hair extension 10, 50 or 110, or each opening 218 and 220 in the hair extension 210, with a hook known in the industry. A tip extension may be inserted during the application process to improve security, fullness and protection of the hair extension. Once the wearer's natural hair is pulled through all of the micro links 20 or 40 in the extension 10, 50 or 110, the micro links are compressed with a plier or clamping tool to secure the extension to the wearer's natural hair. In the case of hair extension 210, it is not necessary to compress. The installation proceeds progressively to the next section until all desired areas or the entire scalp is covered.

The number of extensions per section is based upon the requirements of the wearer and the location of the target areas for adding length and thickness. Various sizes of extensions with varying sizes of micro links may be utilized on the same head. Smaller micro links typically are used on the top and sides of the head. However, the subject invention enables larger extensions, which typically are appropriate for the back of the head, to be utilized on the top and sides of the head, while remaining discrete and natural-looking.

This is particularly advantageous for styles requiring volume and density at the top and sides of the head.

The hair extensions 10, 50, 110 and 210 may be installed in any desired pattern, for example bricklayer patterns, checkerboard patterns, horizontal rows placed consecutively with or without spacing, depending upon desired fullness, or no pattern at all where a tousled look is desired. The installation proceeds in progressive sections, wherein the desire number of extensions are added in the desired pattern. In one method of the invention, the installation begins below the ears, proceeds a section behind the ears, then above the ears, and proceeding successively in one to two-inch sections to the sides and crown of the head.

The extensions 10, 50, 110 and 210 may be brushed, shampooed, conditioned and blow dried. Hair products also may be used on the hair extensions 10, 50, 110 and 210.

It now will be appreciated that the present invention comprises a plurality of bands or strips, 12, 14, 112, 114, 212 and 214 having hair extensions secured thereto with micro links 20, 40 or 50 adhered between the plurality of bands or strips to enable attachment to the wearer's native hair. A first band comprising the hair extension has a front side and a backside, to either of which the micro links may be attached. Similarly, a second band comprising the hair extension has a front side and a back side, to either of which micro links may be attached. The two bands are sandwiched together with the respective back sides of the first and second bands facing each other so that a double-sided sandwich of extensions, 10, 110 or 210 is formed around the micro links 20 or 40, with the extension hair either exposed exteriorly on or sandwiched interiorly in the hair extension, and the wearer's native hair is concealed inside the micro link 20 or 40 therebetween. Additionally, hair extension 50 may be positioned between bands 112 and 114 to create a double hair extension. This sandwiched hair extension configuration 10, 110 and 210 arrives at the salon pre-assembled and ready for installation. The bands to which the micro links 20, 40 and 50 are attached can be made from polyurethane, hair lace, thin skin, gauze, mesh or sheer fabrics, or other materials and may be tinted to match the wearer's skin tone. The wearer's native hair is pulled through the micro links 20, 40 or 50 in the sandwich with a hook, after which the micro link is flattened or compressed to complete the installation of each section of the sandwiched hair extension.

Additionally, the present invention provides a hair extension 50 comprising a micro link 40 wrapped with a material 43 to which extension hair 116 is secured and/or a compressible link having perforations or openings in the sidewalls of the micro link 40 through which extension hair 116 is secured. The wearer's native hair is pulled through an inner annulus 46 of the micro link 40, thus concealing the micro link from view. The hair link 50 may be used as a standalone extension or coupled with the sandwiched hair extension 10, 110 or 210 to provide a full yet discrete head of extension hair.

Further, the present invention provides a hair extension 210 having openings or slits in lieu of micro links between the two assembled components, leaving openings 218 therebetween in communication with openings 220 in the bands 212 and 214. The wearer's native hair is threaded first through openings 218 in the top of the hair extension 210 and then through side openings 218 in the bands 212 and 214, thus eliminating the need for micro links and creating an extremely lightweight, comfortable and seamless hair extension.

It now will be appreciated that invention comprises hair extensions, with micro-links adhered between a plurality of layers to allow for attachment to the wearer's native hair or openings for threading the wearer's native hair through the hair extension. The hair extension is comprised of first and second bands each having a front side and a backside to which the micro links are attached with adhesive or other securing means. Extension hair is attached to either the front side or the back side of the first and second bands. The two bands are sandwiched together with the back sides of the first band and second band facing each other so that a double-sided "sandwich" of extensions is formed around the micro-links or accommodating openings. This hair extension would arrive pre-assembled prior to installation. The wearer's native hair is pulled through the micro-link in the hair extension with an extension hook. Once the hair is pulled through, a plier tool is used to press the micro-link flat and complete the installment of the individual hair extension piece. Interposing the micro links between the bands hides the micro links in the wearer's native hair and provides a more natural and desirable look.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. A method of installing a pre-assembled hair extension in the hair of a wearer, the method comprising the steps of:

forming a part in the hair of the wearer to create a section;

placing the pre-assembled hair extension near the part formed in the hair of the wearer, the pre-assembled hair extension comprising:

a band having a front side and a back side;

a first weft of extension hair attached to either the front side or the back side of the band, or both;

a plurality of micro links attached to either the front side or the back side of the band, wherein at least one of the plurality of micro links forms an exterior surface and an annulus adapted to receive a wearer's natural hair;

a second weft of extension hair, independent of the first weft of the extension hair, the second weft of extension hair being attached to the at least one of the plurality of micro links, wherein the exterior surface of the at least one of the plurality of micro links is fully wrapped with a material for receiving the second weft of extension hair on the exterior surface of the at least one of the plurality of micro links so that the second set of extension hair fully covers the exterior surface of the at least one of the plurality of micro links and substantially conceals the at least one of micro link with the second set of extension hair.

2. The method of claim 1, further comprising the step of inserting into the annulus of each of the plurality of micro links a portion of the wearer's hair in the section formed by the part.

3. The method of claim 2, further comprising the step of compressing each of the plurality of micro links to secure each of the plurality of micro links to the respective portion of the wearer's hair inserted into each of the plurality of micro links.

4. The method of claim 1, wherein the plurality of micro links are attached to the back side of the band and further comprising the step of inserting into the annulus of each of the plurality of micro links a portion of the wearer's hair in the section formed by the part.

5. The method of claim 4, further comprising the steps of:
forming an additional part in the hair of the wearer to create a second section,
placing a second pre-assembled hair extension near the additional part formed in the hair of the wearer, the second pre-assembled hair extension comprising:
a band having a front side and a back side;
a first weft of extension hair attached to either the front side or the back side of the band, or both;
a plurality of micro links attached to either the front side or the back side of the band, wherein at least one of the plurality of micro links forms an exterior surface and an annulus adapted to receive a wearer's natural hair;
a second weft of extension hair, independent of the first weft of the extension hair, the second weft of extension hair being attached to the at least one of the plurality of micro links, wherein the exterior surface of the at least one of the plurality of micro links is fully wrapped with a material for receiving the second weft of extension hair on the exterior surface of the at least one of the plurality of micro links so that the second set of extension hair fully covers the exterior surface of the at least one of the plurality of micro links and substantially conceals the at least one of micro link with the second set of extension hair.

6. The method of claim 5, further comprising the step of inserting into the annulus of at least one of the plurality of micro links of the second pre-assembled hair extension a portion of the wearer's hair in the section formed by the additional part.

7. The method of claim 6, further comprising the step of compressing the at least one of the plurality of micro links of the second pre-assembled hair extension to secure the at least one of the plurality of micro links of the second pre-assembled hair extension to the respective portion of the wearer's hair inserted into the at least one of plurality of micro links of the second pre-assemble hair extension.

8. A method of installing a pre-assembled hair extension in the hair of a wearer, the method comprising the steps of:
forming a part in the hair of the wearer to create a section;
placing the first pre-assembled hair extension near the part in the hair of the wearer, the first pre-assembled hair extension comprising:
a micro link having an exterior surface that is fully wrapped with a material for receiving a weft of extension hair on the exterior surface of the micro link so that the weft of extension hair fully covers the exterior surface of the micro link and substantially conceals the micro link with the weft of extension hair.

9. The method of claim 8, wherein the micro link forms an annulus and further comprises the step of inserting into the annulus of the micro link a portion of the wearer's hair in the section formed by the part.

10. The method of claim 9, further comprising the step of compressing the micro link to secure the micro link to the portion of the wearer's hair inserted into the annulus of the micro link.

11. The method of claim 10, further comprising the steps of:
forming an additional part in the hair of the wearer to create a second section;
placing a second pre-assembled hair extension near the additional part formed in the hair of the wearer, the second pre-assembled hair extension comprising:
a micro link having an exterior surface that is fully wrapped with a material for receiving a weft of extension hair on the exterior surface of the micro link so that the weft of extension hair covers the exterior surface of the micro link and substantially conceals the micro link with the weft of extension hair.

12. The method of claim 11, wherein the micro link of the second pre-assembled hair extension forms an annulus and the method further comprises the step of inserting into the annulus of the micro link of the second pre-assembled hair extension a portion of the wearer's hair in the section formed by the first part.

13. The method of claim 12, further comprising the step of compressing the micro link of the second pre-assemble hair extension to secure the micro link of the second pre-assembled hair extension to the portion of the wearer's hair inserted into micro link of the second pre-assemble hair extension.

14. A method of installing a pre-assembled hair extension in the hair of a wearer, the method comprising the steps of:
forming a part in the hair of the wearer to create a section;
placing the pre-assembled hair extension near the part formed in the hair of the wearer, the pre-assembled hair extension comprising:
a first band having a front side and a back side;
a first weft of extension hair attached to the front side or the back side of the first band, or both;
a second band having a front side and a back side;
a plurality of micro links attached to either the back side of the first band or the back side of the second band, or both, wherein at least one of the plurality of micro links forms an exterior surface and an annulus adapted to receive a wearer's natural hair;
a second weft of extension hair, independent of the first weft of the extension hair, the second weft of extension hair being attached to the at least one of the plurality of micro links, wherein the exterior surface of the at least one of the plurality of micro links is fully wrapped with a material for receiving the second weft of extension hair on the exterior surface of the at least one of the plurality of micro links so that the second set of extension hair fully covers the exterior surface of the at least one of the plurality of micro links and substantially conceals the at least one of micro links with the second set of extension hair;
wherein the back side of the first band and the back side of the second band are secured together to conceal the plurality of micro links therebetween.

15. The method of claim 14 further comprising the step of inserting into the annulus of at least one of the plurality of micro links that are attached to either the back side of the first band or the back side of the second band, or both, a portion of the wearer's hair from the section formed by the part.

16. The method of claim 15 further comprising the step of compressing the at least one of the plurality of micro links that are attached to either the back side of the first band or the back side of the second band, or both, to secure the at least one of plurality of micro links to the respective portion of the wearer's hair inserted into the at least one of plurality of micro links.

17. The method of claim 14, wherein the plurality of micro links of are attached to the back side of the first band, and further comprises the step of inserting into the annulus of each of the plurality of micro links a portion of the wearer's hair from the section formed by the part.

18. The method of claim 16 further comprising the steps of:

forming an additional part in the hair of the wearer to create a second section, placing a second pre-assembled hair extension near the additional part formed in the hair of the wearer, the second pre-assembled hair extension comprising:

a band having a front side and a back side;

a first weft of extension hair attached to either the front side or the back side of the band, or both;

a plurality of micro links attached to either the back side of the first band or the back side of the second band, or both, wherein at least one of the plurality of micro links forms an exterior surface and an annulus adapted to receive a wearer's natural hair; and a second weft of extension hair, independent of the first weft of the extension hair, the second weft of extension hair being attached to the at least one of the plurality of micro links, wherein the exterior surface of the at least one of the plurality of micro links is fully wrapped with a material for receiving the second weft of extension hair on the exterior surface of the at least one of the plurality of micro links so that the second set of extension hair fully covers the exterior surface of the at least one of the plurality of micro links and substantially conceals the at least one of micro link with the second set of extension hair.

19. The method of claim 18, further comprising the step of inserting into the annulus of at least one of the plurality of micro links of the second pre-assembled hair extension a portion of the wearer's hair in the second section formed by the additional part.

20. The method of claim 19, further comprising the step of compressing the at least one of the plurality of micro links of the second pre-assembled hair extension to secure the at least one of the plurality of micro links of the second pre-assembled hair extension to the respective portion of the wearer's hair inserted into the at least one of plurality of micro links of the second pre-assemble hair extension.

* * * * *